US010211564B2

(12) United States Patent
Miyazawa et al.

(10) Patent No.: US 10,211,564 B2
(45) Date of Patent: Feb. 19, 2019

(54) CONNECTOR-MOUNTING STRUCTURE AND TERMINAL STAGE

(71) Applicant: YAZAKI CORPORATION, Tokyo (JP)

(72) Inventors: Yuki Miyazawa, Shizuoka (JP); Atsushi Kinpara, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/986,793

(22) Filed: May 22, 2018

(65) Prior Publication Data

US 2018/0351284 A1 Dec. 6, 2018

(30) Foreign Application Priority Data

Jun. 2, 2017 (JP) ..... 2017-109637

(51) Int. Cl.

| | |
|---|---|
| ***H01R 13/52*** | (2006.01) |
| ***H01R 13/518*** | (2006.01) |
| ***H01R 25/00*** | (2006.01) |
| ***H01R 9/24*** | (2006.01) |
| ***H01R 13/74*** | (2006.01) |
| ***H01R 13/621*** | (2006.01) |
| *H01R 9/18* | (2006.01) |

(52) U.S. Cl.

CPC ..... *H01R 13/5202* (2013.01); *H01R 9/2491* (2013.01); *H01R 13/518* (2013.01); *H01R 13/6215* (2013.01); *H01R 13/74* (2013.01); *H01R 25/006* (2013.01); *H01R 9/18* (2013.01)

(58) Field of Classification Search

CPC ..... H01R 13/5202; H01R 13/6584; H01R 13/6215; H01R 13/6581; H01R 13/719; H01R 13/74; H01R 9/2491; H01R 25/006; H01R 13/518

USPC ..... 439/519

See application file for complete search history.

(56) References Cited

U.S. PATENT DOCUMENTS

| | | | | |
|---|---|---|---|---|
| 5,823,507 A * | 10/1998 | Inden | B60T 8/3675 | 251/129.15 |
| 6,721,483 B2 * | 4/2004 | Grubish | G02B 6/4444 | 174/92 |
| 6,884,119 B2 * | 4/2005 | Brooks | H01R 13/719 | 439/620.01 |
| 8,847,843 B2 * | 9/2014 | Miwa | H01Q 1/007 | 343/702 |

(Continued)

FOREIGN PATENT DOCUMENTS

JP 2007-280913 A 10/2007

*Primary Examiner* — Jean F Duverne

(74) *Attorney, Agent, or Firm* — Kenealy Vaidya LLP

(57) ABSTRACT

A connector-mounting structure includes a case and a connector mounted on the case. The connector has a connector housing, a terminal, a waterproof elastic member, and a connector holding plate fixed to an inner surface of the case. An outer size of the connector housing is larger than a hole size of a through-hole of the case. The waterproof elastic member has a sealing portion. A size of a recess of the connector holding plate is larger than an outer size of a flange portion of the connector housing. A hole size of a housing insertion hole of the connector holding plate is larger than an outer circumferential size of a main body of the connector housing. An outer circumferential size of the insertion portion is smaller than the hole size of the through-hole.

3 Claims, 10 Drawing Sheets

(56) References Cited

U.S. PATENT DOCUMENTS

| | | | | |
|---|---|---|---|---|
| 9,343,941 | B2 * | 5/2016 | Okamoto | H01R 13/5202 |
| 9,391,485 | B2 * | 7/2016 | Kobayashi | H01R 9/24 |
| 9,666,994 | B2 * | 5/2017 | Hwang | H01R 13/6581 |
| 9,698,528 | B2 * | 7/2017 | Nishida | B60L 3/00 |
| 9,728,901 | B2 * | 8/2017 | Mukuno | H01R 13/6584 |
| 2007/0218747 | A1 | 9/2007 | Takehara | |
| 2009/0291586 | A1 | 11/2009 | Takehara | |

* cited by examiner

CONNECTOR-MOUNTING STRUCTURE AND TERMINAL STAGE

CROSS REFERENCE TO RELATED APPLICATIONS

This application is based on Japanese Patent Application (No. 2017-109637) filed on Jun. 2, 2017, the contents of which are incorporated herein by reference.

BACKGROUND OF THE INVENTION

1. Field of the Invention

The present invention relates to a connector-mounting structure for mounting of a connector in a case and a terminal stage including the connector-mounting structure.

2. Description of the Related Art

In recent years, a structure for connecting an inverter and a motor directly, that is, without using a wire harness, has come to be used in hybrid vehicles and electric vehicles. JP-A-2007-280913 discloses an example of such a structure. In JP-A-2007-280913, a connector is mounted in a motor case fixedly. On the other hand, another connector is mounted in an inverter case so as to be able to absorb a positional deviation. More specifically, this connector is mounted in the inverter case so as to be able to absorb a positional deviation by sandwiching, for example, a rubber packing between the inverter case and the connector.

The above related technique absorbs a positional deviation by sandwiching, for example, a rubber packing between the inverter case and the connector. However, considering how this structure receives vibration or the like during a drive, it is understood that a load acts only on the packing. Thus, there is concern about whether sufficient reliability is secured by this structure.

SUMMARY OF THE INVENTION

The present invention has been made in the above circumstances, and an object of the invention is therefore to provide a connector-mounting structure and a terminal stage capable of securing sufficient reliability that relates to absorption of a positional deviation.

To attain the above object, one aspect of the invention provides, a connector-mounting structure including:

a case having a through-hole; and a connector which has an insertion portion configured to be inserted in the through-hole and is mounted on the case, wherein the connector includes:

a connector housing;

a terminal housed inside the connector housing; and a waterproof elastic member disposed outside the connector housing;

a connector holding plate which is fixed to an inner surface of the case;

wherein an outer size of the connector housing is larger than a hole size of the through-hole, and the connector housing includes a flange portion having a first surface that faces the inner surface of the case and a second surface that is opposite to the first surface;

wherein the waterproof elastic member has a sealing portion that faces the first surface of the flange portion and is provided so as to be in sliding contact with the inner surface of the case;

wherein the connector holding plate which includes:

a recess configured to press the flange portion so that the second surface of the flange portion is provided so as to be in sliding contact with a bottom surface of the recess;

a housing insertion hole that penetrates through the connector holding plate from the bottom of the recess; and an inner surface fixing portion that surrounds the recess;

wherein a size of the recess is larger than an outer size of the flange portion;

wherein a hole size of the housing insertion hole of the connector holding plate is larger than an outer circumferential size of a main body of the connector housing; and wherein an outer circumferential size of the insertion portion of the connector is smaller than the hole size of the through-hole of the case.

In this connector-mounting structure, the connector 3 is held slidably by the inner surface of the case via the connector holding plate while waterproofness is secured. Thus, the connector-mounting structure is free of a phenomenon that a load acts on only the waterproof elastic member when a positional deviation is absorbed as well as when, for example, vibration or the like is received during a drive after absorption of a positional deviation. As a result, the reliability relating to absorption of a positional deviation can be made higher than in the related example.

For example, a positioning portion is provided on a portion of the case in which the through hole is disposed near, and the positioning portion positions the case with respect to a counterpart case in which a counterpart connecter to be fitted in or with the connector is mounted.

In this connector-mounting structure, the position of the connector can be determined by positioning the case with respect to the counterpart case using the positioning portion. As a result, a stable connection state can be established between the connector and the counterpart connector.

To attain the above object, another aspect of the invention provides a terminal stage including:

the connector-mounting structure;

a flexible conductive path having one end which is connected to the terminal of the connector housing;

a conductive device connection terminal which is connected to the other end of the flexible conductive path; and an insulative terminal holding portion which holds the conductive device connection terminal.

Including the connector-mounting structure according to the above configurations, this terminal stage can make the reliability relating to absorption of a positional deviation higher than in the related example.

The connector-mounting structure and the terminal stage provide an advantage that sufficient reliability can be secured that relates to absorption of a positional deviation.

DETAILED DESCRIPTION OF THE EXEMPLARY EMBODIMENTS

A connector-mounting structure includes a case having a through-hole, a connector which has an insertion portion inserted in the through-hole and is thereby mounted in the case, and a connector holding plate. The connector includes a connector housing having a flange portion, a terminal, and a waterproof elastic member having a sealing portion. The connector holding plate has a recess, a housing insertion hole, and an inner surface fixing portion. The size of the recess is larger than the outer size of the flange portion, and the hole size of the housing insertion hole is larger than the main body outer circumferential size of the connector housing. The outer circumferential size of the insertion portion of the connector is smaller than the hole size of the through-hole of the case.

Embodiment

Figure 1:
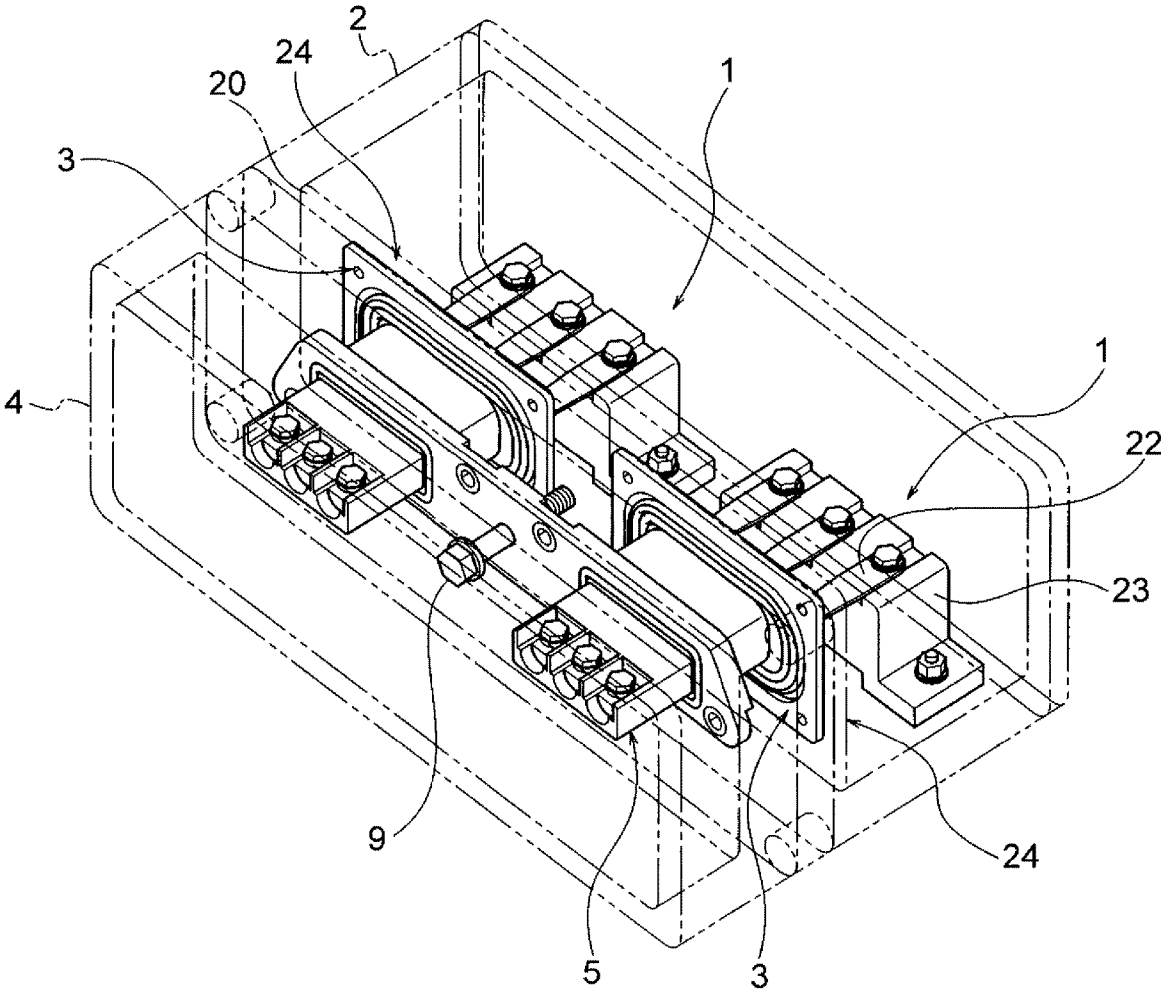
FIG. 1 is a perspective view of connector-mounting structures and terminal stages according to an embodiment of the present invention.
Figure 2:
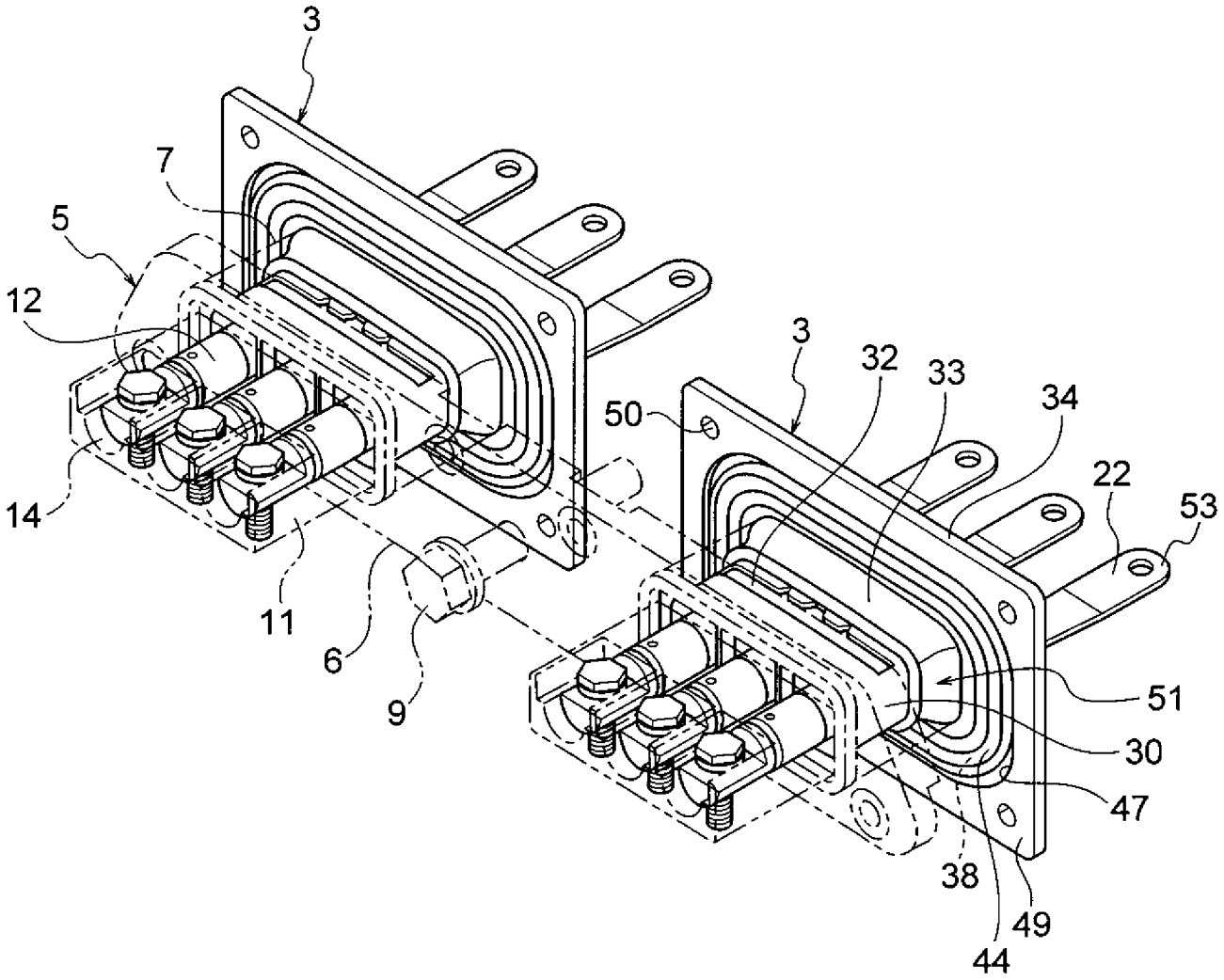
FIG. 2 is a perspective view of connectors illustrated in FIG. 1.
Figure 3:
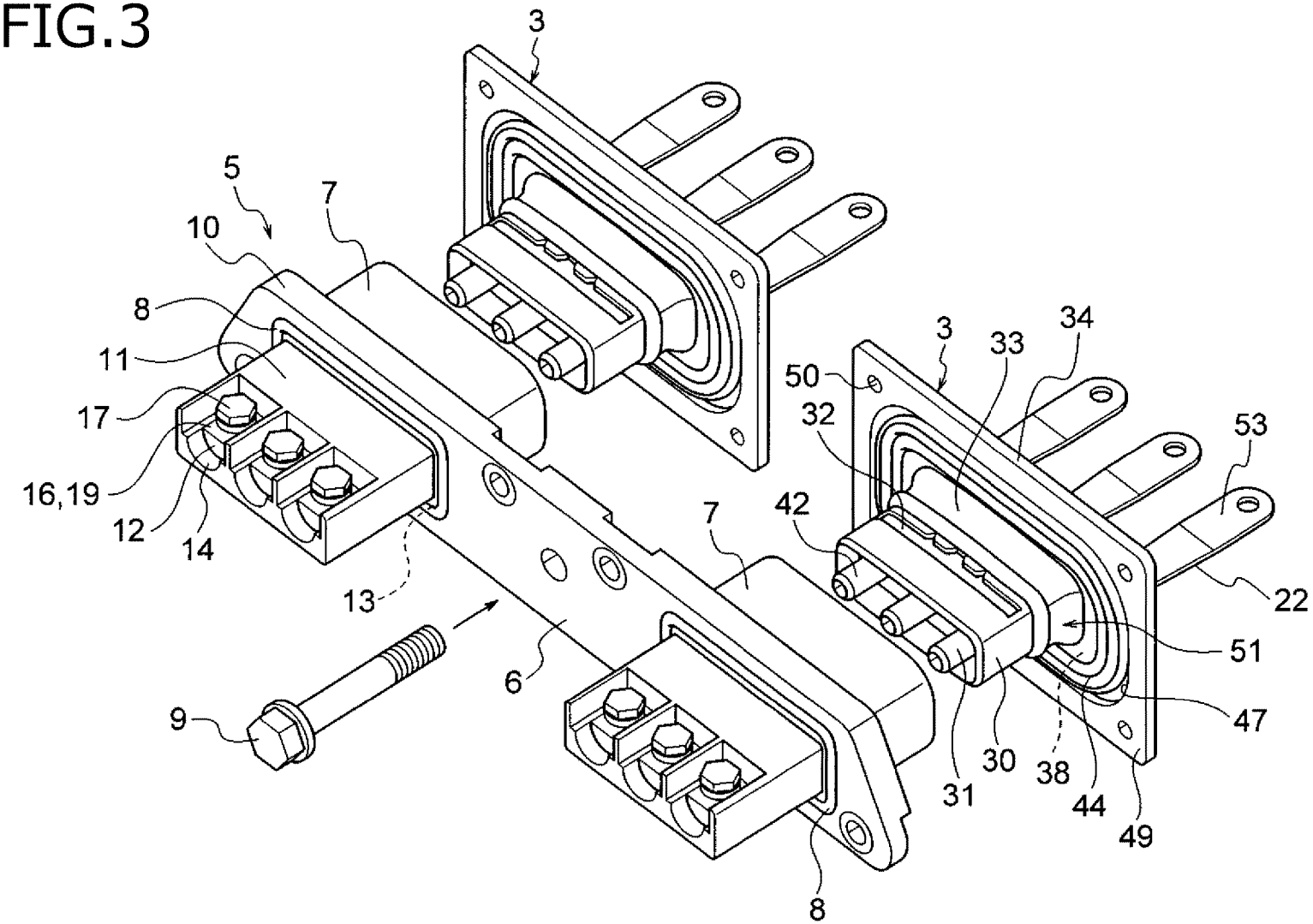
FIG. 3 is a perspective view of the connectors illustrated in FIG. 1 and a counterpart connector.
Figure 4:
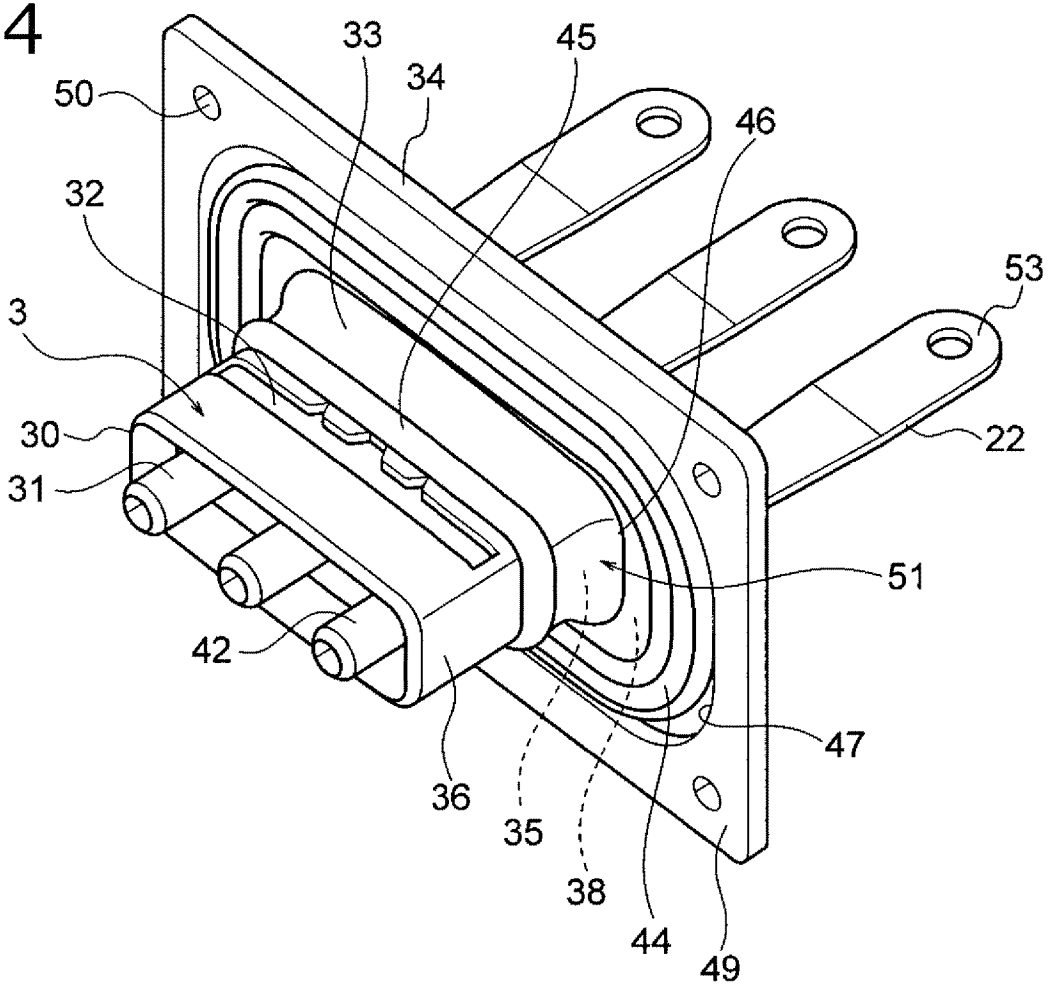
FIG. 4 is an enlarged perspective view of one of the connectors illustrated in FIG. 3.
Figure 5:
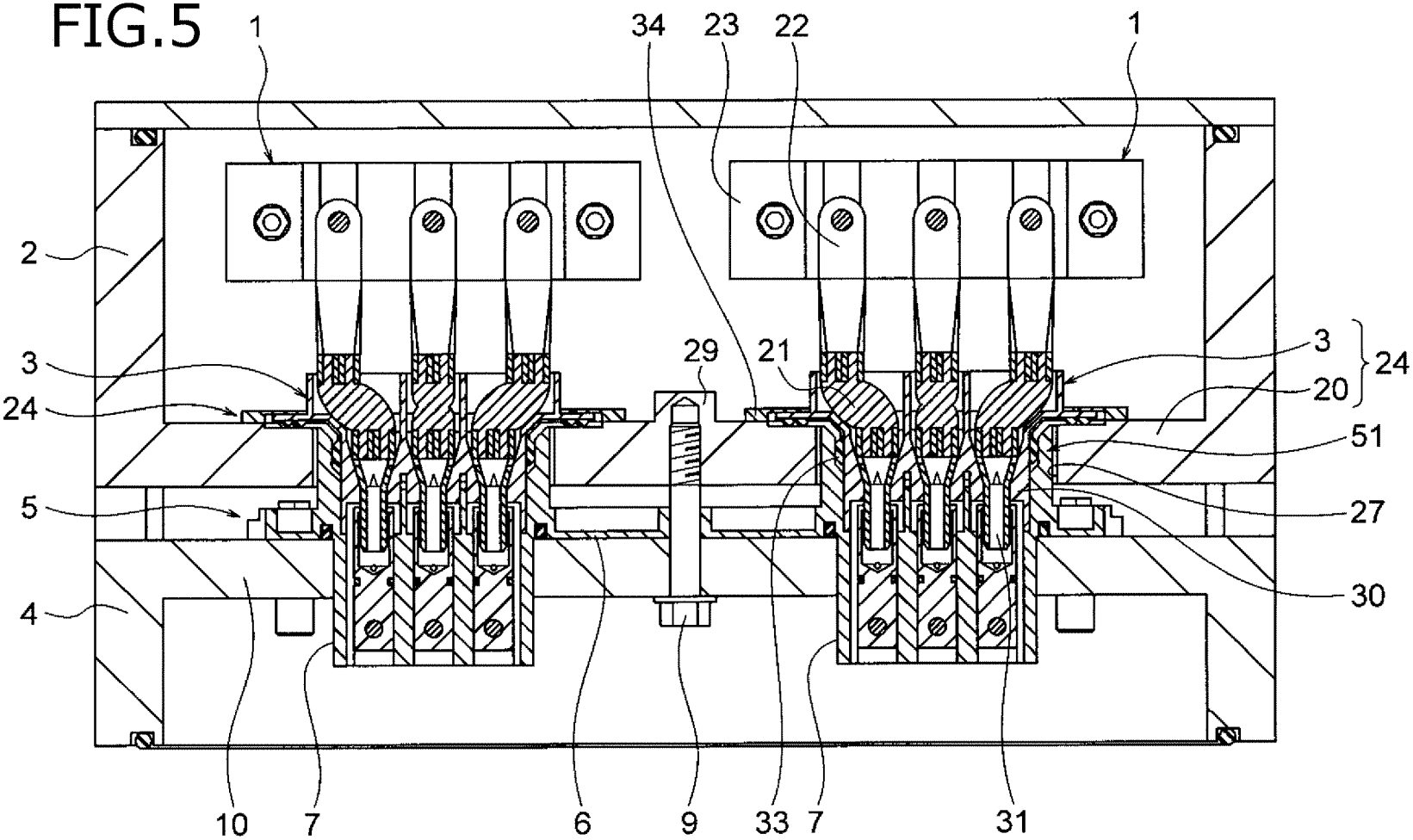
FIG. 5 is a sectional view of the connector-mounting structures and the terminal stages.
Figure 6:
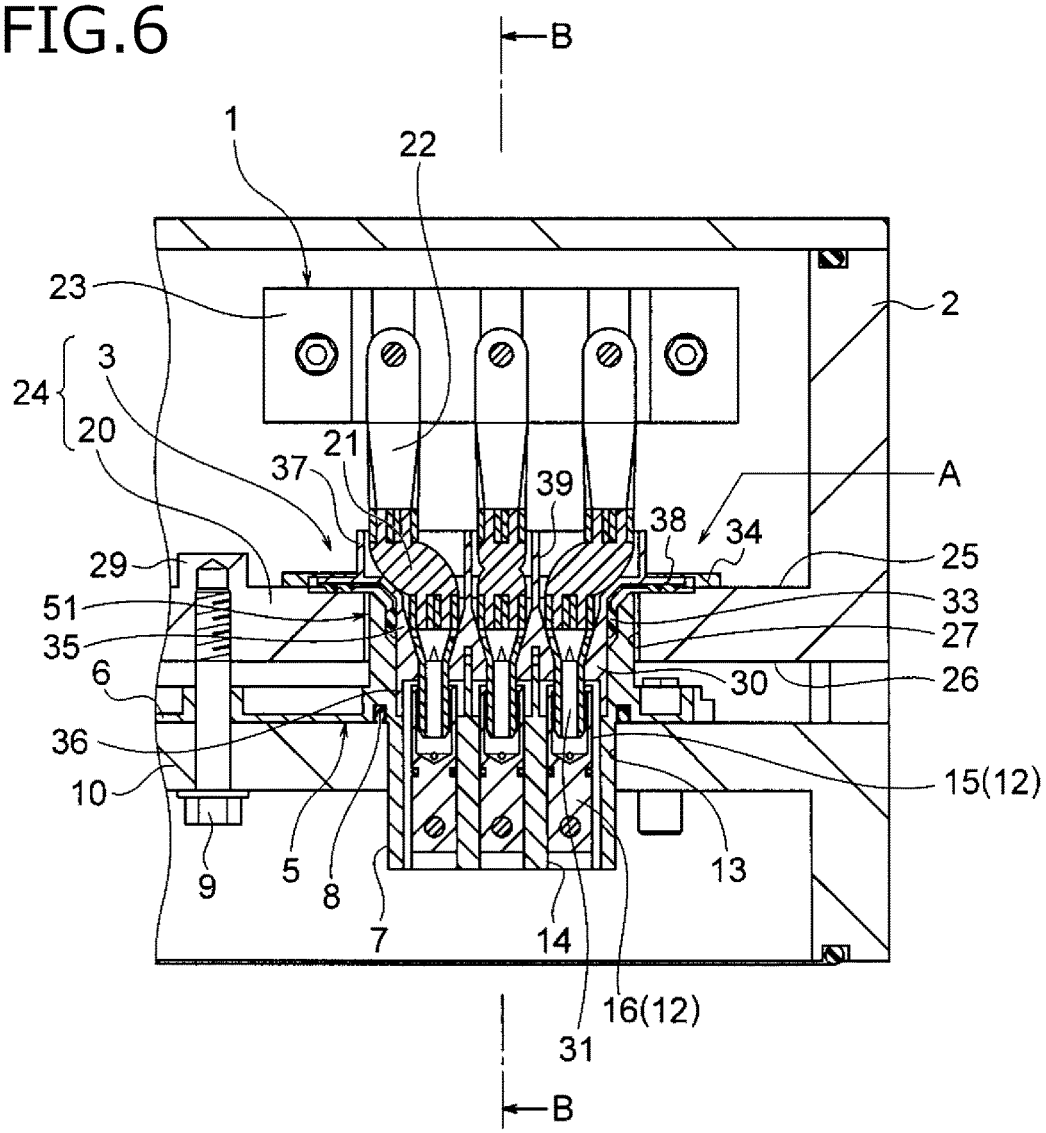
FIG. 6 is an enlarged sectional view of part of FIG. 5.
Figure 7:
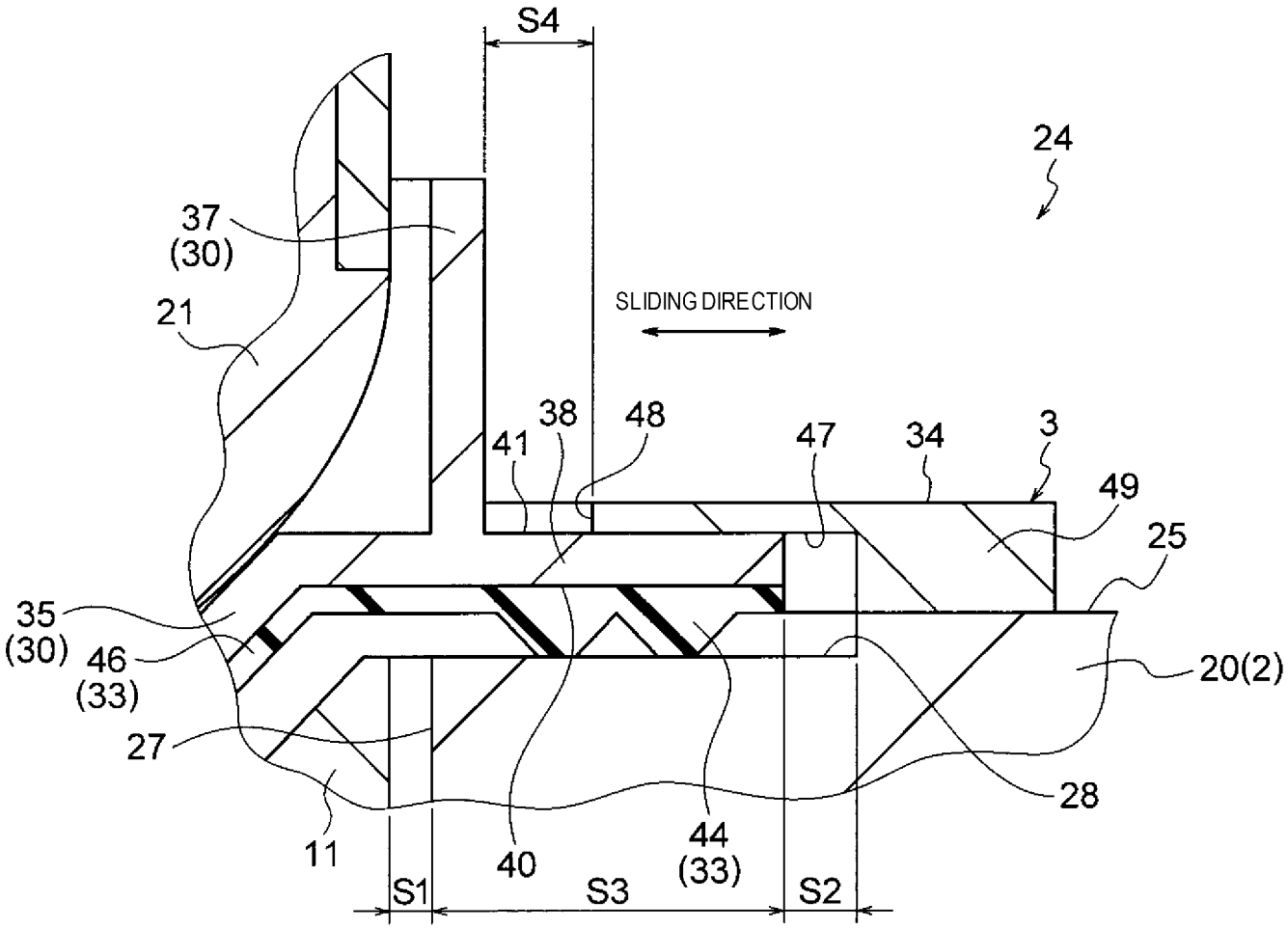
FIG. 7 is an enlarged sectional view of a part, indicated by arrow A, of FIG. 6.
Figure 8:
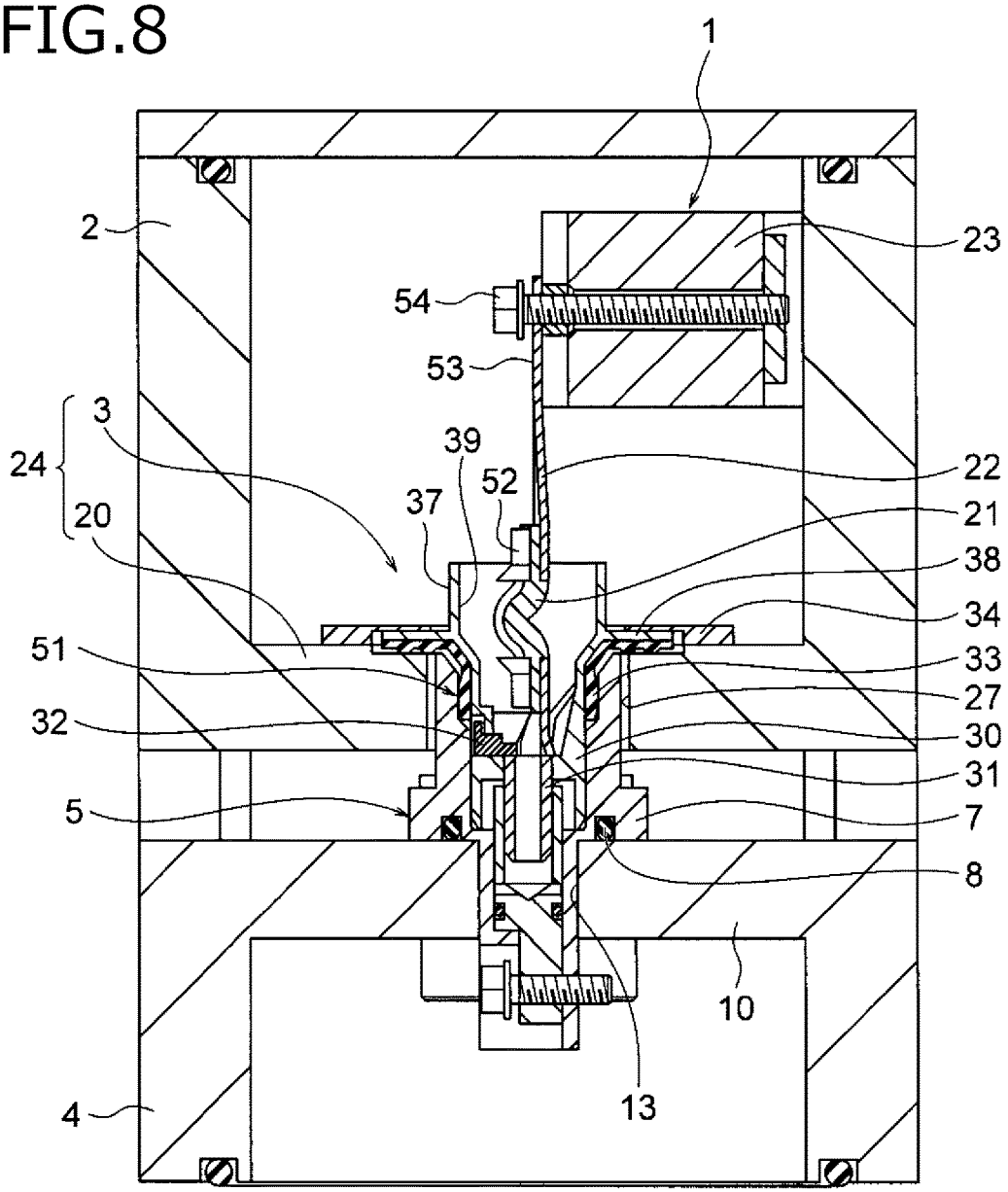
FIG. 8 is a sectional view taken along line B-B in FIG. 6.
Figure 9:
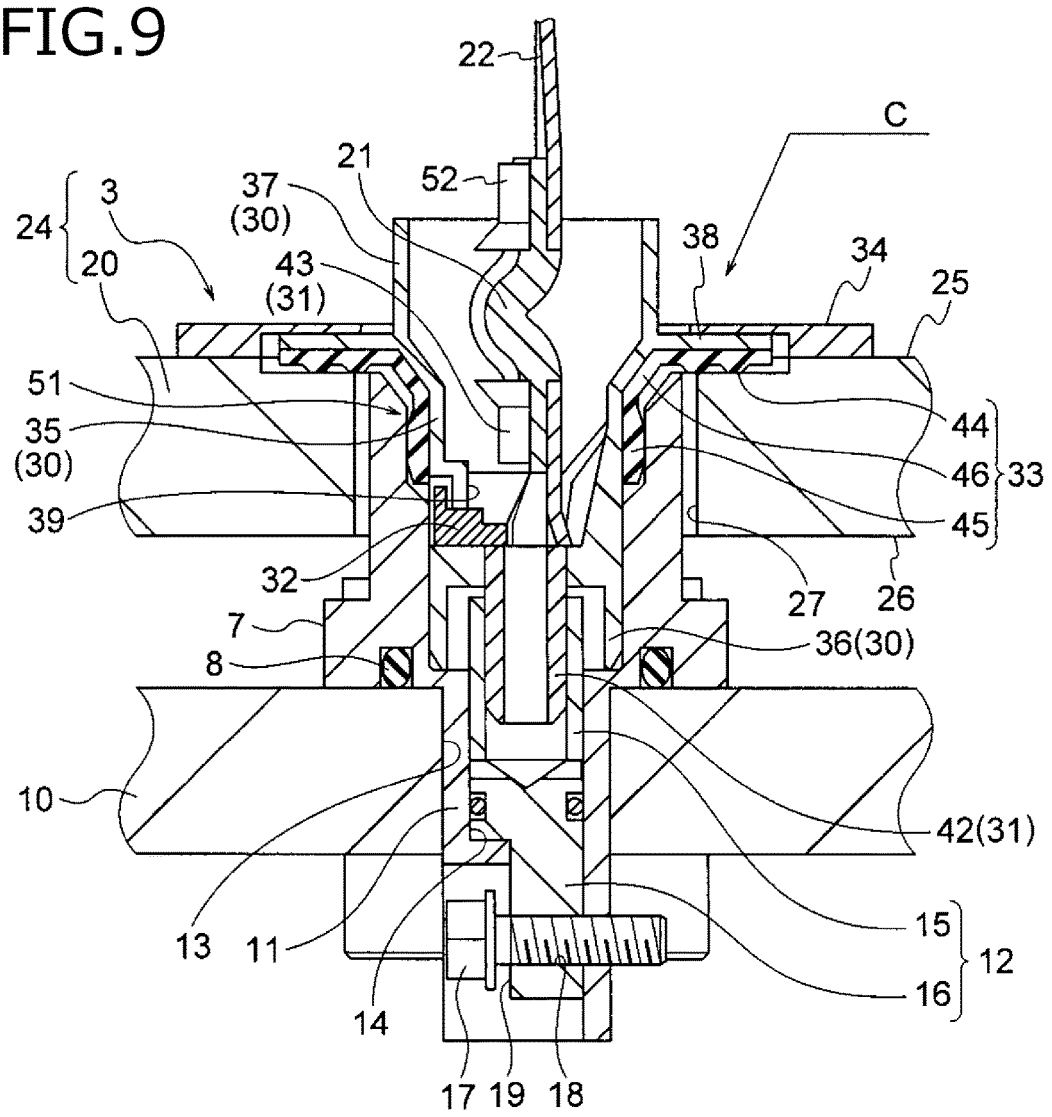
FIG. 9 is an enlarged sectional view of FIG. 8.
Figure 10:
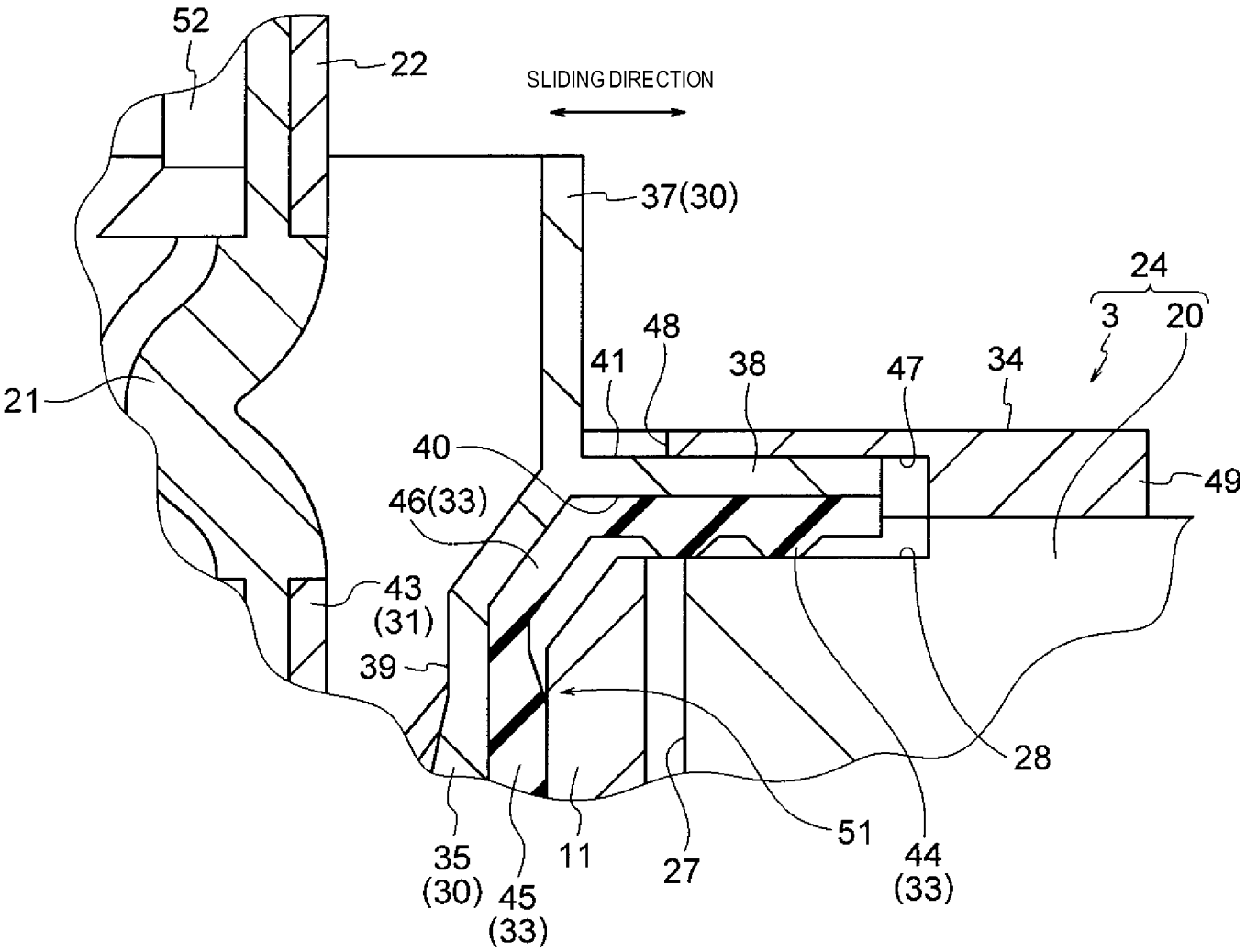
FIG. 10 is an enlarged sectional view of a part, indicated by arrow C, of FIG. 9.

An embodiment of the present invention will be hereinafter described with reference to the drawings. FIG. 1 is a perspective view of connector-mounting structures 24 and terminal stages 1 according to the embodiment. FIG. 2 is a perspective view of connectors 3. FIG. 3 is a perspective view of the connectors 3 and a counterpart connector 5. FIG. 4 is an enlarged perspective view of one of the connectors 3. FIG. 5 is a sectional view of the connector-mounting structures 24 and the terminal stages 1. FIG. 6 is an enlarged sectional view of part of FIG. 5. FIG. 7 is an enlarged sectional view of a part, indicated by arrow A, of FIG. 6. FIG. 8 is a sectional view taken along line B-B in FIG. 6. FIG. 9 is an enlarged sectional view of FIG. 8. FIG. 10 is an enlarged sectional view of a part, indicated by arrow C, of FIG. 9.

<Terminal Stage 1>

Referring to FIG. 1, the terminal stages 1 according to the embodiment are ones to be installed in an inverter of a hybrid vehicle or an electric vehicle. More specifically, a pair of terminal stages 1 are mounted in an inverter case 2 (case). Each of the pair of terminal stages 1 is such that its connector 3 can absorb a positional deviation with respect to a counterpart connector 5 that is mounted in a motor case 4 (counterpart case) of a motor.

The counterpart connector 5 will be described first and then the structure of each terminal stage 1 will be described.

<Counterpart Connector 5>

As illustrated in FIGS. 1, 2, 3, 6, and 9, the counterpart connector 5 is composed of a plate-like connector link portion 6, a pair of connector main bodies 7 which are integrated with the connector link portion 6, packings 8 provided in the respective connector main bodies 7, and a positioning bolt 9. The pair of connector main bodies 7 have the same structure and hence one of them will be described below. As seen from FIGS. 1-3, each connector main body 7 has a terminal stage structure that enables connection of three systems.

<Connector Link Portion 6>

As illustrated in FIGS. 1-3, the connector link portion 6 is provided to arrange the pair of connector main bodies 7 at a prescribed interval. The connector link portion 6 is fixed to the outer surface of a wall 10 of the motor case 4 (a bolt fastening structure will not be described). The connector link portion 6 establishes a state that the pair of connector main bodies 7 are not moved relative to the wall 10 of the motor case 4.

<Connector Main Body 7>

As illustrated in FIGS. 2, 3, 6, and 9, each connector main body 7 is composed of a counterpart connector housing 11 and three female terminals 12. The counterpart connector housing 11 has a portion that is inserted in a through-hole 13 that penetrates through the wall 10 of the motor case 4, a tubular portion that projects toward the inverter side, and a portion that projects to inside the motor case 4. The thus-configured counterpart connector housing 11 is formed with three terminal housing rooms 14 which houses the respective female terminals 12.

<Female Terminal 12>

As illustrated in FIGS. 2, 3, 6, and 9, each female terminal 12 has a cylindrical round terminal portion 15 and a device connection terminal portion 16 which is continuous with the round terminal portion 15. The device connection terminal portion 16 is formed with a nut portion 18 to which a bolt 17 for connection to a connection terminal (not shown) of the motor is fastened. The device connection terminal portion 16 is also formed with a connection surface 19 for the connection terminal of the motor.

<Bolt 9>

As illustrated in FIGS. 1-3, the bolt 9 is inserted through the wall 10 and the connector link portion 6 from inside the motor case 4 and fastened to a female screw portion 29 (positioning portion; described later) of the inverter case 2. The bolt 9 is used for positioning the motor case 4 and the inverter case 2 with each other near the connector main bodies 7 and thereby determining the basic positions of the connectors 3 of the terminal stages 1 with respect to the respective connector main bodies 7 which are not movable.

<Terminal Stage 1>

As illustrated in FIGS. 1, 5, and 8, as described above, the pair of terminal stages 1 are disposed in the inverter case 2 (case). The pair of terminal stages 1 have the same structure and hence one of them will be described below. Each terminal stage 1 includes part of a wall 20 of the inverter case 2, a connector 3, three flexible conductive paths 21, three conductive device connection terminals 22, and an insulative terminal holding member 23. In other words, each terminal stage 1 includes a connector-mounting structure 24 for mounting of the connector 3 on the wall 20.

<Wall 20 and Through-Hole 27>

As illustrated in FIGS. 6 and 9, the wall 20 has an inner surface 25 and an outer surface 26 which are flat and parallel with each other. Through-holes 27 penetrate through the wall 20. The inner surface 25 is formed with shallow recesses 28. Each through-hole 27 has a hole size that is larger than the outer circumferential size of an insertion portion 51 (described later) of the connector 3 (larger by a dimension S1 illustrated in FIG. 7). In other words, each through-hole 27 has such a size as to allow the insertion portion 51 to move in all directions (360°) therein. Since in the embodiment the counterpart connector housing 11 is inserted into each through-hole 27, the hole size of each through-hole 27 is also larger than the outer circumferential size of the counterpart connector housing 11.

The recess 28 is a one-step recess formed around each through-hole 27. The bottom surface of the recess 28 is a surface with which a sealing portion 44 of a waterproof elastic member 33 (described later) can be in elastic contact and sliding contact. The size of the recess 28 is larger than the outer size of the sealing portion 44 (larger by a dimension S2 illustrated in FIG. 7).

Reference numeral 29 denotes a female screw portion (positioning portion) that projects from the inner surface 25 of the wall 20. A male screw portion of the bolt 9 is screwed into the female screw portion 29. When the male screw portion of the bolt 9 is screwed into the female screw portion 29, the terminal stages 1 are positioned with respect to the wall 10 of the motor case 4 and the counterpart connectors 5.

<Connector 3>

As illustrated in FIGS. 4, 6, and 9, each connector 3 is composed of a connector housing 30, three male terminals 31 (terminals) which are housed in the connector housing 30, and a spacer 32 for preventing coming-off of the terminals 31. Reference numeral 34 denotes a connector holding plate which is fixed to the inner surface 25 of the wall 20.

The connector housing 30 and the spacer 32 of each connector 3 are made of an insulative resin. The male terminals 31 are made of a metal and hence are conductive. The waterproof elastic member 33 is made of a rubber or a resin. The connector holding plate 34 is made of a metal. The individual constituent members will be described below in detail.

<Connector Housing 30>

As illustrated in FIGS. 4, 6, and 9, the connector housing 30 has a housing intermediate portion 35 which corresponds, in position, to the through-hole 27, a housing front portion 36 which projects to the outside of the wall 20, a housing rear portion 37 which projects to the inside of the wall 20, and a flange portion 38 which is a boundary portion between the housing intermediate portion 35 and the housing rear portion 37. The thus-configured connector housing 30 is formed with three terminal housing rooms 39 which house the respective male terminals 31.

When the spacer 32 is inserted through the housing intermediate portion 35 after housing of the male terminals 31, the inserted spacer 32 engages with the male terminals 31, whereby a state is established that the male terminals 31 are prevented from coming off.

<Flange Portion 38>

As illustrated in FIGS. 6, 7, 9, and 10, the outer size of the flange portion 38 is larger than the hole size of the through-hole 27 (larger by a dimension S3 illustrated in FIG. 7). And the outer size of the flange portion 38 is smaller than the size of a recess 47 of the connector holding plate 34 (smaller by the dimension S2 illustrated in FIG. 7). The flange portion 38 has one surface (first surface) 40 which faces the inner surface 25 of the wall 20 and the other surface (second surface) 41 which is opposite to the one surface 40. The one surface 40 and the other surface 41 are flat surfaces.

<Male Terminal 31>

As illustrated in FIGS. 4, 6, and 9, each male terminal 31 has a round terminal portion 42 which is shaped like a round pin and a conductive path connection portion 43 which is continuous with the round terminal portion 42. The conductive path connection portion 43 is a portion for connection to the associated flexible conductive path 21 (described later).

The round terminal portion 42 of each male terminal 31 and the round terminal portion 15 of each female terminal 12 are circular in cross section (example shape) to attain high connection performance (picking property).

<Waterproof Elastic Member 33>

As illustrated in FIGS. 4, 6, 7, 9, and 10, the waterproof elastic member 33 has a flange-shaped sealing portion 44, a tubular inter-housing sealing portion 45, and a link portion 46 which links the portions 44 and 45. The waterproof elastic member 33 serves as a member for securing waterproofness and absorbing vibration.

The sealing portion 44 is provided on the side of the one surface 40 of the flange portion 38 and is formed as a portion (having lip portions (not given a reference symbol)) that can be in elastic contact with a portion (the bottom of the recess 28) of the inner surface 25 of the wall 20. The sealing portion 44 is also formed as a portion that can be in sliding contact with a portion (the bottom of the recess 28) of the inner surface 25 of the wall 20. As in the flange portion 38, the outer size of the thus-formed sealing portion 44 is larger than the hole size of the through-hole 27 (larger by the dimension S3 illustrated in FIG. 7). The outer size of the sealing portion 44 is smaller than the size of the recess 47 of the connector holding plate 34 (smaller by the dimension S2 illustrated in FIG. 7).

The inner circumferential surface of the tubular inter-housing sealing portion 45 is in close contact with the outer circumferential surface of the housing intermediate portion 35. The outer circumferential surface of the tubular inter-housing sealing portion 45 is also in close contact with the inner circumferential surface of the counterpart connector housing 11.

<Connector Holding Plate 34>

As illustrated in FIGS. 4, 6, 7, 9, and 10, the connector holding plate 34 has a shallow recess 47, a housing insertion hole 48 which penetrates through the connector holding plate 34 from the bottom of the recess 47, and an inner surface fixing portion 49 which surrounds the recess 47 directly.

The bottom of the recess 47 is formed so as to be able to support and be in sliding contact with the other surface 41 of the flange portion 38. The recess 47 is formed in such a manner that its side surface is flush with the side surface of the recess 28. The size of the recess 47 is larger than the outer size of the flange portion 38 (larger by the dimension S2 illustrated in FIG. 7).

The housing insertion hole 48 penetrates through the connector holding plate 34 so as to allow the housing rear portion 37 of the connector housing 30 to be inserted through it. The hole size of the housing insertion hole 48 is larger than the main body outer circumferential size of the housing rear portion 37 (larger than a dimension S4 illustrated in FIG. 7).

The inner surface fixing portion 49 is a portion that is fixed to the inner surface 25 of the wall 20. Small-diameter bolt insertion holes 50 penetrate through the inner surface fixing portion 49 near its four respective corners. When small bolts (not shown) are inserted into the respective bolt insertion holes 50 and screwed into the inner surface 25, the connector holding plate 34 is fixed to the inner surface 25 while pressing the flange portion 38 so as to be able to be in sliding contact with it.

<Connector-Mounting Structure 24>

As illustrated in FIGS. 5-10, in each connector-mounting structure 24, the connector 3 is held by the wall 20 in a slidable manner (described later). (The insertion portion 51 which is inserted into the through-hole 27 of the wall 20 corresponds to the term "insertion portion" used in the claims). Each terminal stage 1 is formed in the inverter case 2 by providing the connector-mounting structure 24 with the three flexible conductive paths 21, the three device connection terminals 22, and the insulative terminal holding member 23.

<Three Flexible Conductive Paths 21>

As illustrated in FIGS. 5, 6, 8, and 9, the three flexible conductive paths 21 basically have the same structure (in the embodiment, they are different from each other only in length). In each terminal stage 1, the connector 3 is not connected to the three device connection terminals 22 directly but via the flexible conductive paths 21, respectively. There are no particular limitations on the three flexible conductive paths 21, each of which may be a flexible conductive member such as a braid wire, a covered wire, or a bare wire (the term "flexible" means that the flexible conductive paths 21 can be deformed to such an extent as not to obstruct movement (described later) of the connector 3.)

One ends of the flexible conductive paths 21 are connected to the conductive path connection portions 43 of the male terminals 31 of the connector 3, respectively. The other ends of the flexible conductive paths 21 are connected to the three respective device connection terminals 22.

<Three Device Connection Terminals 22>

As illustrated in FIGS. 4, 5, 6, 8, and 9, the three device connection terminals 22 have the same structure. Each of the three device connection terminals 22 has a conductive path connection portion 52 for connection to the associated flexible conductive path 21 and a tab-shaped electric contact portion 53. The shape, employed in the embodiment, of each device connection terminal 22 is just an example; each device connection terminal 22 may have a proper shape that is suitable for a form of connection to the inverter side.

<Terminal Holding Member 23>

As illustrated in FIGS. 1, 5, and 6, the terminal holding member 23 is a stage-like member and is fixed to the inverter case 2. The terminal holding member 23 is formed so as to be able to hold the three device connection terminals 22 in such a manner that they are spaced from each other. Reference numeral 54 denotes a bolt that is used for connection to the inverter side.

<Workings and Advantages of Terminal Stage 1 Including Connector-Mounting Structure 24>

On the motor side, the positions of the counterpart connectors 5 are fixed. Thus, in connecting the inverter to the motor directly, each terminal stage 1 including the connector-mounting structure 24 having the above-described structure provides the following workings and advantages in a case that the position of the inverter-side connector 3 is deviated to some extent.

In the connector-mounting structure 24 of each terminal stage 1, as illustrated in FIGS. 6 and 9, the connector 3 is held by the inner surface 25 of the wall 20 via the connector holding plate 34. Since the connector 3 is held so as to be slidable in the direction indicated by an arrow in FIGS. 7 and 10 while waterproofness is secured, the connector 3 itself slides and absorbs its positional deviation if any. The thus-configured connector 3 is fitted in and connected to the connector main body 7.

Enabling such sliding of the connector 3, unlike in the related example, the connector-mounting structure 24 is free of a phenomenon that a load acts on only the packing even when a positional deviation is absorbed as well as when, for example, vibration or the like is received during a drive after absorption of a positional deviation. That is, there does not occur a phenomenon that a load acts on only the waterproof elastic member 33. As a result, the reliability relating to absorption of a positional deviation can be made higher than in the related example.

It goes without saying that the invention can be practiced in various modified manners without departing from the spirit and scope of the invention.

The invention can be applied to not only direct electrical connection portions between an inverter and a motor as in the above-described embodiment but also direct electrical connection portions between two devices of other kinds.

What is claimed is:

1. A connector-mounting structure comprising:

a case having a through-hole; and a connector which has an insertion portion configured to be inserted in the through-hole and is mounted on the case, wherein the connector comprises:

a connector housing;

a terminal housed inside the connector housing;

a waterproof elastic member disposed outside the connector housing; and a connector holding plate which is fixed to an inner surface of the case;

wherein an outer size of the connector housing is larger than a hole size of the through-hole, and the connector housing includes a flange portion having a first surface that faces the inner surface of the case and a second surface that is opposite to the first surface;

wherein the waterproof elastic member has a sealing portion that faces the first surface of the flange portion and is provided so as to be in sliding contact with the inner surface of the case;

wherein the connector holding plate which includes:

a recess configured to press the flange portion so that the second surface of the flange portion is provided so as to be in sliding contact with a bottom surface of the recess;

a housing insertion hole that penetrates through the connector holding plate from the bottom of the recess; and an inner surface fixing portion that surrounds the recess;

wherein a size of the recess is larger than an outer size of the flange portion;

wherein a hole size of the housing insertion hole of the connector holding plate is larger than an outer circumferential size of a main body of the connector housing; and wherein an outer circumferential size of the insertion portion of the connector is smaller than the hole size of the through-hole of the case.

2. The connector-mounting structure according to claim 1, wherein a positioning portion is provided on a portion of the case in which the through hole is disposed near; and wherein the positioning portion positions the case with respect to a counterpart case in which a counterpart connecter to be fitted in or with the connector is mounted.

3. A terminal stage comprising:

the connector-mounting structure according to claim 1;

a flexible conductive path having one end which is connected to the terminal of the connector housing;

a conductive device connection terminal which is connected to the other end of the flexible conductive path; and an insulative terminal holding portion which holds the conductive device connection terminal.

* * * * *